US010377594B2

(12) United States Patent
Tokonami et al.

(10) Patent No.: US 10,377,594 B2
(45) Date of Patent: Aug. 13, 2019

(54) SHEET FEEDER AND IMAGE-FORMING APPARATUS

(71) Applicant: KYOCERA Document Solutions Inc., Osaka-shi (JP)

(72) Inventors: Minoru Tokonami, Osaka-shi (JP); Hidehisa Konishi, Osaka-shi (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 15/935,307

(22) Filed: Mar. 26, 2018

(65) Prior Publication Data

US 2018/0282089 A1 Oct. 4, 2018

(30) Foreign Application Priority Data

Mar. 28, 2017 (JP) ..... 2017-063316

(51) Int. Cl.

| | |
|---|---|
| ***B65H 5/06*** | (2006.01) |
| ***G03G 15/00*** | (2006.01) |
| ***B65H 3/52*** | (2006.01) |
| ***B65H 7/14*** | (2006.01) |

(52) U.S. Cl.

CPC ..... *B65H 5/062* (2013.01); *B65H 3/5215* (2013.01); *B65H 7/14* (2013.01); *G03G 15/6511* (2013.01); *B65H 2513/10* (2013.01); *B65H 2553/414* (2013.01); *G03G 2215/00616* (2013.01); *G03G 2215/00645* (2013.01); *G03G 2215/00679* (2013.01)

(58) Field of Classification Search

CPC ..... B65H 2513/10; B65H 2513/11; B65H 2553/51; G03G 2215/00645; G01D 5/34738

See application file for complete search history.

(56) References Cited

U.S. PATENT DOCUMENTS 4,987,299 A * 1/1991 Kobayashi ..... G01P 3/366 250/231.14
6,100,519 A * 8/2000 Wang ..... G01D 5/347 250/231.13
7,265,336 B2 * 9/2007 Hataguchi ..... G01D 5/34707 250/231.13

(Continued)

FOREIGN PATENT DOCUMENTS

JP 2005-257813 9/2005

*Primary Examiner* — Jeremy R Severson

(74) *Attorney, Agent, or Firm* — Gerald E. Hespos; Michael J. Porco; Matthew T. Hespos

(57) ABSTRACT

A sheet feeder includes a roller, a reflector, a sensor, and a rotating speed detector. The reflector is integrally attached to the roller, the reflector including first reflecting surfaces and second reflecting surfaces arranged alternately along a circumference direction of the roller. The sensor includes a light emitter and a light receiver. The rotating speed detector is configured to detect a rotating speed of the roller based on a result of the detection by the sensor. Each of the first reflecting surfaces reflects the inspection light at a first reflection ratio, and provides a first reflection light path along which the inspection light is directed to the light receiver. Each of the second reflecting surfaces reflects the inspection light at a second reflection ratio smaller than the first reflection ratio, and provides a second reflection light path along which the inspection light is directed outside the light receiver.

11 Claims, 11 Drawing Sheets

(56) References Cited

U.S. PATENT DOCUMENTS

| | | | | |
|---|---|---|---|---|
| 9,200,927 | B2 * | 12/2015 | Holzapfel | G01D 5/38 |
| 9,376,287 | B2 * | 6/2016 | Asano | B65H 43/00 |
| 9,797,752 | B1 * | 10/2017 | Ruh | G01D 5/3473 |
| 9,823,096 | B2 * | 11/2017 | Sakata | G01D 5/34715 |
| 10,145,711 | B2 * | 12/2018 | Boonsom | G01D 5/34715 |
| 2015/0323351 | A1 * | 11/2015 | Sakata | G01D 5/30<br>250/231.13 |

* cited by examiner

SHEET FEEDER AND IMAGE-FORMING APPARATUS

INCORPORATION BY REFERENCE

This application claims the benefit of Japanese Patent Application No. 2017-63316 filed on Mar. 28, 2017, the entire contents of which are incorporated herein by reference.

BACKGROUND

The present disclosure relates to a sheet feeder capable of feeding a sheet to a predetermined position, and an image-forming apparatus having the sheet feeder.

An image-forming apparatus such as a printer, a copier, or a facsimile typically includes an image-forming section for carrying out an image-forming process to a sheet, a sheet feeder for storing sheets and for feeding the sheets to the image-forming section, and a sheet path along which the sheet is carried through the image-forming section. The sheet feeder and the sheet path include a plurality of rollers for carrying sheets. For example, the sheet feeder includes a payout roller that pays out a sheet stored in a tray, a feed roller that delivers the sheet that has been paid out to the sheet path, and a separation roller pressure-contacted to the feed roller and preventing overlapping of sheets.

While the rollers are demanded to rotate in an intended manner, an expected rotating speed may often not be obtained due to continued use. For example, the separation roller can be worn due to continued use, and may not rotate following the feed roller successfully. In this case, the separation roller is required to be replaced. In order to monitor time for replacement, a sensor for detecting a rotating speed of the separation roller is provided for the sheet feeder in some cases. As a sensor for detecting a rotating speed of a rotating body, for example, an encoded-type using a reflector with a slit is known.

SUMMARY

A sheet feeder according to one aspect of the present disclosure includes a roller, a reflector, a sensor, and a rotating speed detector. The roller includes a roller shaft, and a roller main body attached to the roller shaft. The reflector is integrally attached to one of the roller shaft and the roller main body, the reflector including first reflecting surfaces and second reflecting surfaces arranged alternately along a circumference direction of the roller main body. The sensor includes a light emitter that emits inspection light to the reflector, and a light receiver that receives the inspection light reflected on the reflector. The rotating speed detector is configured to detect a rotating speed of the roller based on a result of the detection by the sensor. Each of the first reflecting surfaces reflects the inspection light at a first reflection ratio, and provides a first reflection light path along which the inspection light is directed to the light receiver. Each of the second reflecting surfaces reflects the inspection light at a second reflection ratio smaller than the first reflection ratio, and provides a second reflection light path along which the inspection light is directed outside the light receiver.

Further, an image-forming apparatus according to another aspect of the present disclosure includes an image-forming section for forming an image on a sheet, and the sheet feeder for feeding a sheet to the image-forming section.

DETAILED DESCRIPTION

[Overall Structure of Image-Forming Apparatus]

Figure 1:
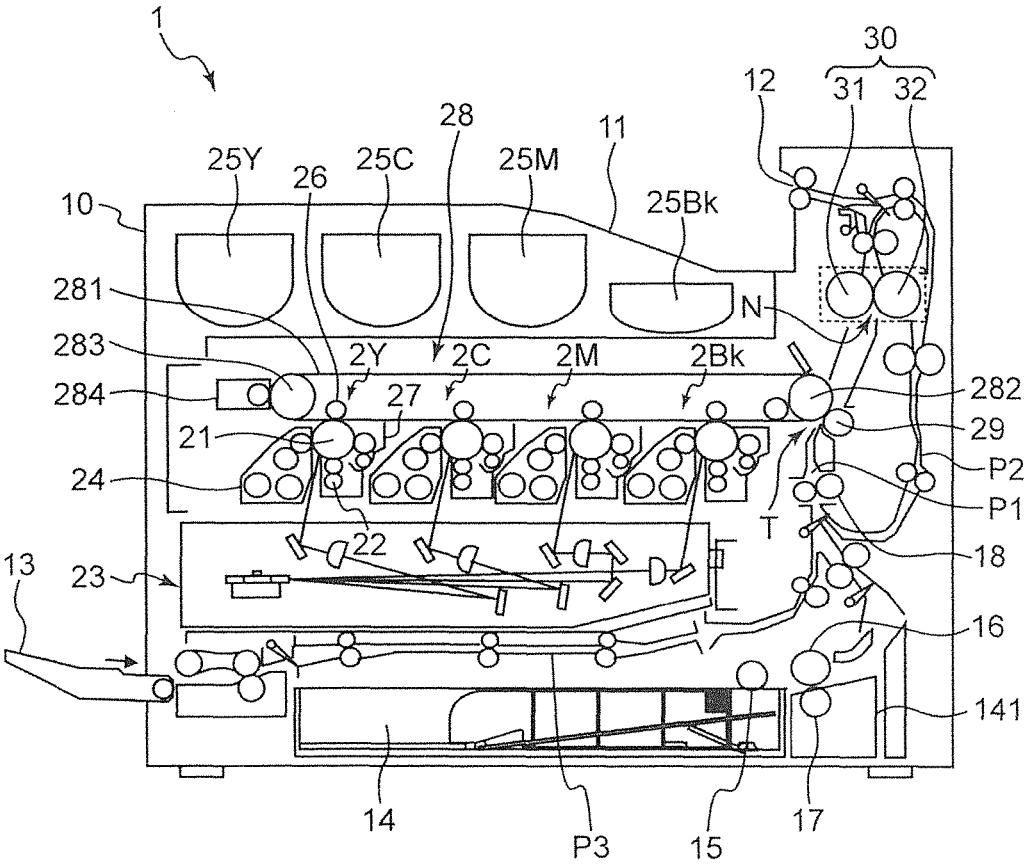
FIG. 1 is a schematic longitudinal sectional view illustrating an image-forming apparatus according to an embodiment of the present disclosure.

Hereinafter, an embodiment of the present disclosure will be described in detail with reference to the drawings. FIG. 1 is a schematic cross-sectional view illustrating an internal structure of an image-forming apparatus 1 according to the embodiment of the present disclosure. The image-forming apparatus 1 is a color printer including a substantially rectangular main body housing 10, image-forming units 2Y, 2C, 2M, 2Bk (image-forming sections) housed in the main body housing 10, an optical scanning device 23, an intermediate transfer unit 28, and a fixing device 30.

For a top surface of the main body housing 10, a catch tray 11 is provided. A sheet discharge outlet 12 is opened facing the catch tray 11. On a side wall of the main body housing 10, a manual feeding tray 13 is provided in an openable and closable manner. At a lower part of the main body housing 10, a sheet cassette 14 for storing sheets to which an image-forming process is carried out is provided in a removable manner in a direction perpendicular to the sheet plane of FIG. 1.

Each of the image-forming units 2Y, 2C, 2M, 2Bk forms a toner image (image) to a sheet in a color corresponding one of yellow, cyan, magenta, and black, based on image information transmitted from an external device such as a computer. The image-forming units 2Y, 2C, 2M, 2Bk are tandem-provided at predetermined intervals in a horizontal direction. Each of the image-forming units 2Y, 2C, 2M, 2Bk includes a photoreceptor drum 21 that carries an electrostatic latent image and a toner image, a charging unit 22 that charges a peripheral surface of the photoreceptor drum 21, a developing unit 24 that forms a toner image by having a developer attach to the electrostatic latent image, toner containers 25Y, 25C, 25M, and 25Bk that supply toner respectively in yellow, cyan, magenta, and black to the developing unit 24, a primary transfer roller 26 that carries out primary transfer of the toner image formed on the photoreceptor drum 21, and a cleaning unit 27 that removes residual toner over the peripheral surface of the photoreceptor drum 21. The optical scanning device 23 irradiates the peripheral surfaces of the photoreceptor drums 21 of the respective colors with light, the peripheral surfaces being surfaces to be scanned, and forms an electrostatic latent image on each of the peripheral surfaces.

The intermediate transfer unit 28 carries out primary transfer of the toner images respectively formed on the photoreceptor drums 21. The intermediate transfer unit 28 includes a transfer belt 281 that revolves while in contact with the peripheral surface of each of the photoreceptor drums 21, and a driving roller 282 and a driven roller 283 over which the transfer belt 281 is suspended. The transfer belt 281 is pressed by the primary transfer roller 26 against the peripheral surfaces the photoreceptor drums 21. The toner images on the respective photoreceptor drums 21 are primary-transferred on the same position over the transfer belt 281. With this, a full-color toner image is formed on the transfer belt 281.

A secondary transfer roller 29 that forms a secondary transfer nip portion T is provided facing the driving roller 282 with the transfer belt 281 therebetween. The full-color toner image over the transfer belt 281 is secondary-transferred onto the sheet at the secondary transfer nip portion T. Toner that remains over a peripheral surface of the transfer belt 281 without being transferred onto sheet is collected by a belt cleaning unit 284 disposed facing the driven roller 283.

The fixing device 30 includes a fixing roller 31 that have a heat source therein, and a pressure roller 32 that, together with the fixing roller 31, constitutes a fixing nip portion N. The fixing device 30 heats and pressurizes a sheet on which the toner image has been transferred at the secondary transfer nip portion T at the fusing nip portion N, to carry out a fixing process for fixing toner to the sheet. The sheet to which the fixing process has been carried out is ejected onto the catch tray 11 through the sheet discharge outlet 12.

Within the main body housing 10, a sheet path along which a sheet is conveyed is provided. The sheet path includes a main conveying path P1 extending vertically from vicinity of a lower part to vicinity of an upper part of the main body housing 10 through the secondary transfer nip portion T and the fixing device 30. A downstream end of the main conveying path P1 continues to the sheet discharge outlet 12. A reverse conveying path P2 that is used in double face printing to reverse and convey a sheet extends from a downmost stream end to vicinity of an upstream end of the main conveying path P1. Further, a conveying path P3 for manual feeding from the manual feeding tray 13 to the main conveying path P1 is disposed above the sheet cassette 14.

The sheet cassette 14 (sheet feeder) receives a sheet to be fed to the image-forming units 2Y, 2C, 2M, 2Bk, and includes a sheet storing portion for storing a stack of sheets. In vicinity of an upper right portion of the sheet cassette 14, a pickup roller 15, a feed roller 16 (driving roller), and a separation roller 17 (roller) are provided. The pickup roller 15 pays out a top sheet of the stack of sheets one by one. The feed roller 16 feeds the sheet payed out by the pickup roller 15 to the upstream end of the main conveying path P1. The feed roller 16 is powered by a driving force from a drive source that is not illustrated in the drawings. The separation roller 17 is pressure-contacted to the feed roller 16 to prevent overlapping of sheets. The separation roller 17 has a peripheral surface in contact with a peripheral surface of the feed roller 16, and rotates following rotation of the feed roller 16. On an upstream side of the secondary transfer nip portion T of the main conveying path P1, a pair of resist rollers 18 that send out a sheet to the secondary transfer nip portion T at predetermined timing is disposed.

When one-side printing (image formation) is performed to the sheet, a sheet is sent to the main conveying path P1 either from the sheet cassette 14 or the manual feeding tray 13, and a transfer process of a toner image is carried out to the sheet at the secondary transfer nip portion T, and a fixing process for fixing the transferred toner is carried out to the sheet by the fixing device 30. Then, the sheet is ejected onto the catch tray 11 through the sheet discharge outlet 12. On the other hand, when double face printing is performed to the sheet, the transfer process and the fixing process are carried out to one side of the sheet, and then the sheet is partially ejected to the catch tray 11 through the sheet discharge outlet 12. Subsequently, the sheet is switched back and carried back to vicinity of the upstream end of the main conveying path P1 through the reverse conveying path P2. Thereafter, the transfer process and the fixing process are carried out to the other side of the sheet, and then the sheet is ejected to the catch tray 11 through the sheet discharge outlet 12.

With the image-forming apparatus 1 described above, a plurality of rollers are provided in order to convey a sheet along the conveying paths P1, P2, and P3. These rollers are demanded to rotate at an intended rotating speed in order to convey a sheet stably, but may often not rotate as expected due to various reasons. One such reason is wear of the rollers. The rollers are become worn after a long time of use, because peripheral surfaces of the rollers are brought into contact with a sheet to convey the sheet. In the case the driven roller is worn, a nip force to the driving roller becomes weak, and may not follow and rotate successfully due to slipping or the like. Specifically, the rotating speed changes. On the other hand, the driving roller may not easily change its rotating speed even after a long time of use due to a driving force given to the driving roller. However, there is a case in which the driving roller cannot rotate at an intended rotating speed due to a trouble or the like in a transmission system such as a gear.

The change in the rotating speed of the rollers results in a problem in a conveying operation of a sheet, that is, an image-forming operation. Accordingly, it is desirable to monitor the rotating speed of some of the rollers provided for the image-forming apparatus 1. In this embodiment, an example in which the rotating speed of the separation roller 17 is monitored is taken. A peripheral surface of the separation roller 17 wears due to continued use, and as a result of this, may not successfully rotate following the feed roller 16. Therefore, the separation roller 17 with reduced performance needs to be replaced. Accordingly, it is possible to monitor time for replacement of the separation roller 17 by sensing the rotating speed of the separation roller 17.

[Rotation Detecting Mechanism of Separation Roller]

Figure 2:
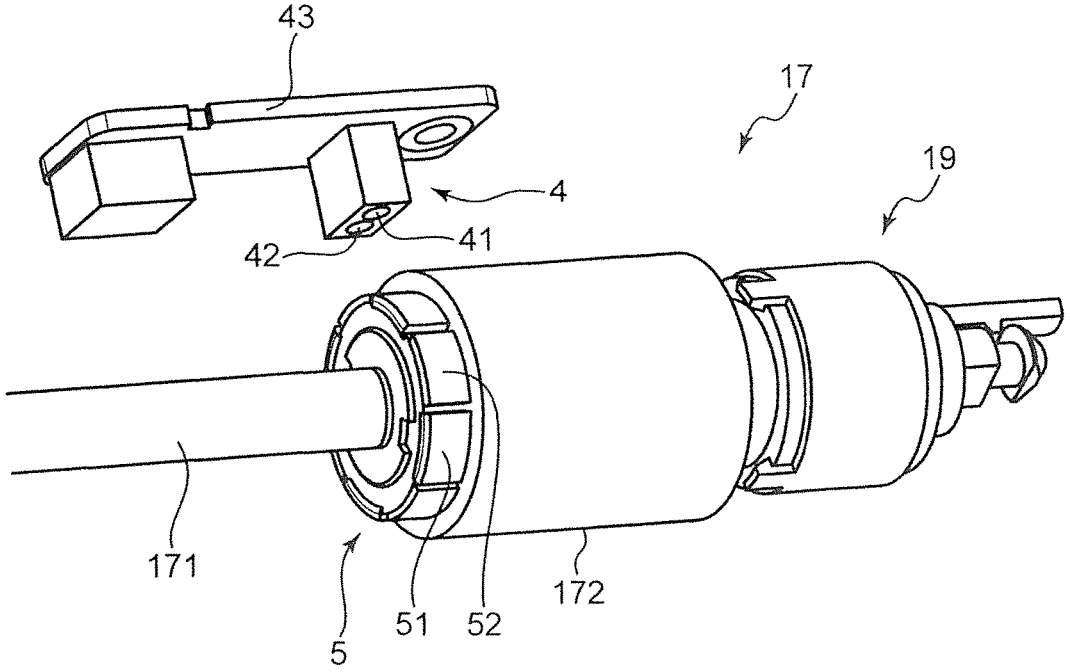
FIG. 2 is a perspective view illustrating a separation roller and a rotation sensor.
Figure 3:
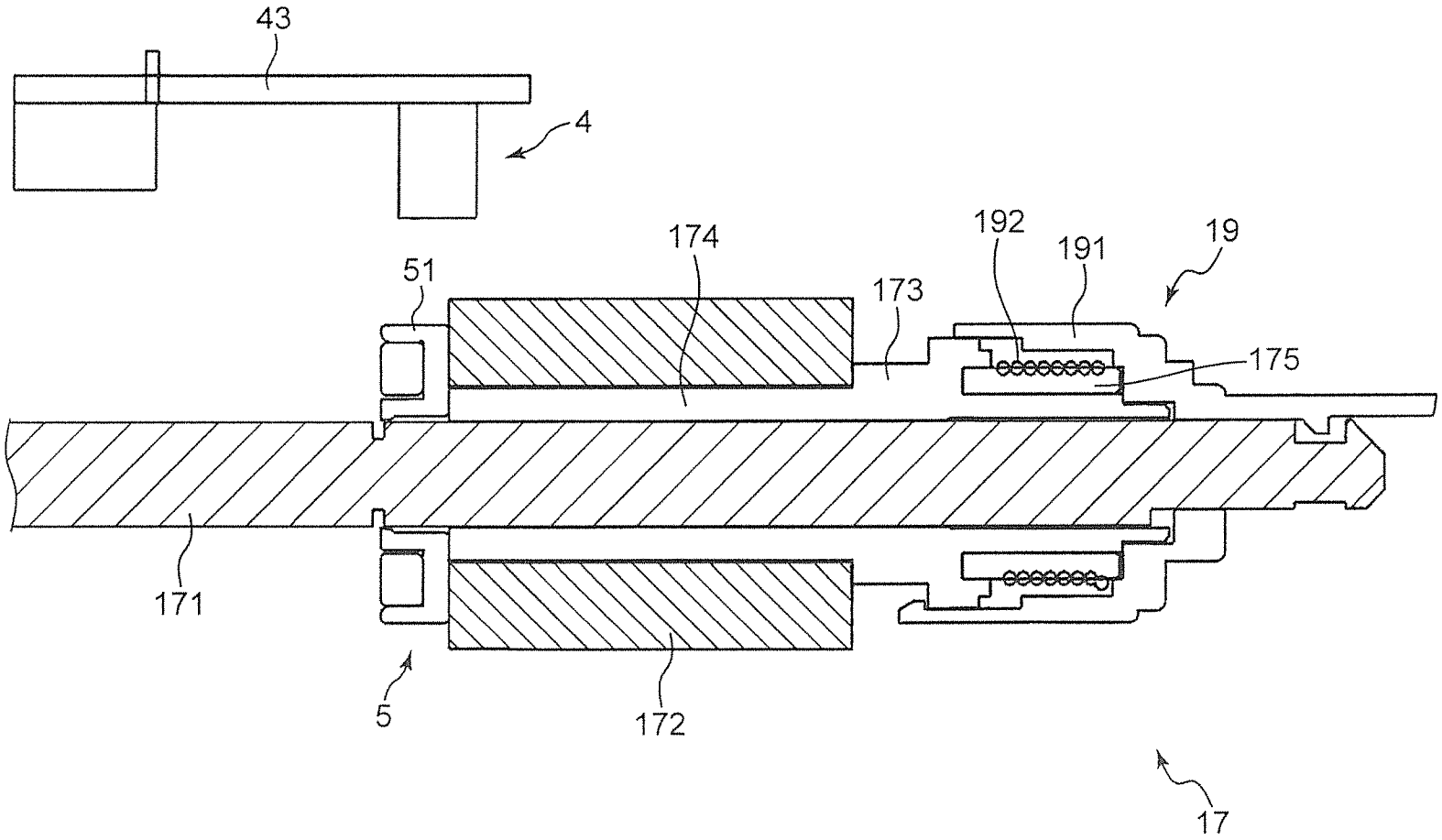
FIG. 3 is a cross-sectional view viewed along a direction of a roller axis of the separation roller and the rotation sensor.

FIGS. 2 and 3 illustrate a rotation detecting mechanism of the separation roller 17. The rotation detecting mechanism includes the separation roller 17, a rotation sensor 4 (sensor), and a pulley 5 (reflector). FIG. 2 is a perspective view illustrating the rotation detecting mechanism, and FIG. 3 is a cross-sectional view viewed along a direction of a roller axis of the separation roller 17.

The separation roller 17 includes a linear roller shaft 171, a roller main body 172 attached to the roller shaft 171 and contributes to conveying of the sheet, and a torque limiter 19 that switches between rotation and stopping of the roller main body 172. The separation roller 17 is attached to a housing 141 (roller attaching portion) of the sheet cassette 14 illustrated in FIG. 1. The housing 141 is disposed at the downstream end of the sheet cassette 14 in the sheet conveying direction, and is provided with a guiding surface for guiding a sheet to the main conveying path P1. The separation roller 17 is removably attached to the housing 141, and replaced when the roller main body 172 becomes worn.

The roller shaft 171 is a fixed shaft which is an axis of rotation of the roller main body 172. The roller main body 172 is configured such that at least a peripheral surface of the roller main body 172 is made of a member having a high friction coefficient, such as silicon rubber, urethane rubber, or EPDM. The roller main body 172 is supported by a holder 173 rotatable about an axis of the roller shaft 171. The holder 173 has, on one end, a roller retaining portion 174 for retaining the roller main body 172, and, on the other end, an attachment portion 175 in which the torque limiter 19 is fitted. The roller main body 172 (and the holder 173) is attached to the roller shaft 171 via the torque limiter 19, and rotates about the fixed roller shaft 171 when torque of a predetermined value or above is applied.

The torque limiter 19 includes an external cylinder 191 fitted into the attachment portion 175, and a spring 192 disposed between the attachment portion 175 and the external cylinder 191. The external cylinder 191 is rotatably inserted through the roller shaft 171, and rotates integrally with the holder 173 about the roller shaft 171 when predetermined value or above is applied to the roller main body 172. One end of the spring 192 is engaged with a side of the holder 173 (the attachment portion 175), and the other end of the spring 192 is engaged with the external cylinder 192.

When a sheet comes into a sheet feeding nip portion between the feed roller 16 and the separation roller 17, friction with the sheet applies the roller main body 172 with corresponding torque. In this case, the spring 192 is wrung to provide a state in which the holder 173 and the external cylinder 191 are connected (torque transmitted state). Accordingly, the roller main body 172 rotates about the roller shaft 171 along with the holder 173 and the external cylinder 191. Therefore, the separation roller 17 rotates following the feed roller 16 to send the sheet that has come into the sheet feeding nip portion out to the downstream side. On the other hand, if more than one sheet comes into the sheet feeding nip portion, no torque works on the roller main body 172. In this case, the spring 192 is not wrung, and the roller main body 172 may not rotate about the roller shaft 171. Therefore, only one of the sheets that is in contact with the feed roller 16 is sent out to the downstream side.

The rotation sensor 4 is a reflective optical sensor, and including a probe unit having a light emitter 41 and a light receiver 42, and a sensor substrate 43 on which the probe unit is mounted. The light emitter 41 is configured by an LED or the like that emits inspection light such as infrared light, and irradiates the pulley 5 (reflector) with the inspection light. The light receiver 42 is configured by a photosensitive element such as a photodiode, and receives reflection light from the pulley 5 of the inspection light. The light emitter 41 and the light receiver 42 are desirably arranged so that regular reflection light of the inspection light is received by the light receiver 42, that is, an incident angle of the light and a reflection angle of the light become equal with respect to a normal line at a position irradiated with light from the pulley 5 (inspection light). The sensor substrate 43 is assembled to the main body housing 10 or the sheet cassette 14 so that the light emitter 41 and the light receiver 42 face the pulley 5 with a predetermined distance.

The pulley 5 is a reflector that is integrally attached to the holder 173 holding the roller main body 172, and includes first reflecting surfaces 51 and second reflecting surfaces 52 alternately arranged along a circumference direction of the roller main body 172. To be more specific, the pulley 5 is attached at an end portion of the roller retaining portion 174 such that the pulley 5 is arranged adjacent to a side surface of the roller main body 172 in an axial direction of the roller shaft 171, and the pulley 5 integrally rotates along with the holder 173 and the roller main body 172. Here, in a case of a different embodiment in which a roller that rotates without providing the torque limiter 19 (a roller that integrally rotates along with a roller shaft) is to be detected, the pulley 5 may be attached to the roller shaft.

The pulley 5 includes a pulley peripheral surface having a cylindrical outer peripheral surface whose outer diameter is smaller than that of the peripheral surface of the roller main body 172. With this, the pulley 5 may not hinder a sheet conveying operation by the roller main body 172. The pulley peripheral surface includes the first reflecting surfaces 51 and the second reflecting surfaces 52 arranged alternately along the circumference direction of the pulley 5, each of the first and second reflecting surfaces having a predetermined width. In FIG. 2, the pulley peripheral surface is divided into eight sections substantially evenly in the circumferential direction, and four first reflecting surfaces 51 and four second reflecting surfaces 52 are alternately arranged in the eight sections. Specifically, one first reflecting surface 51 and one second reflecting surface 52 form an arc-like surface having a width of about 45° in the circumferential direction.

Figure 4B:
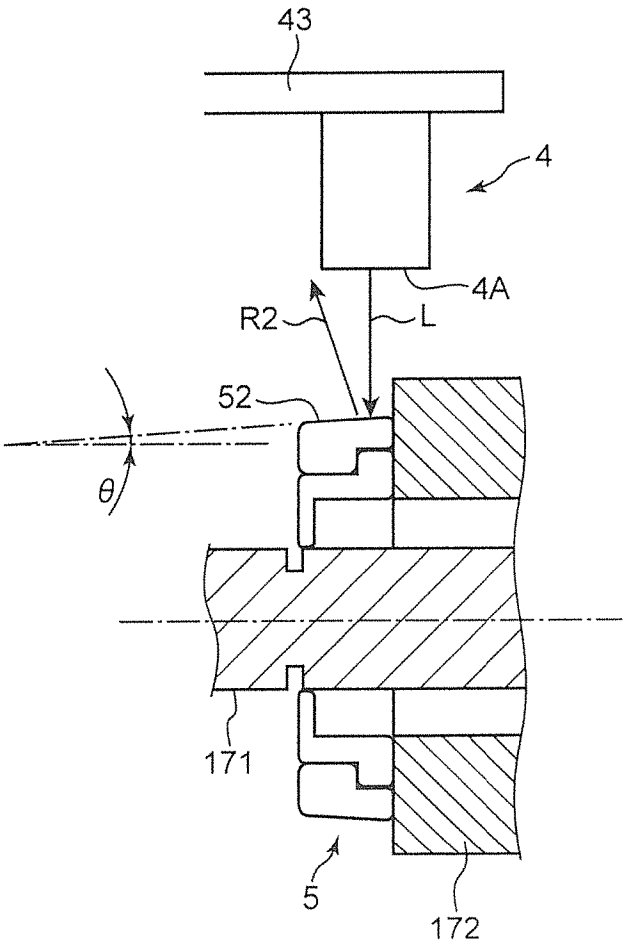
FIG. 4B is an enlarged cross-sectional view illustrating a portion of a second reflecting surface of the reflector.
Figure 4A:
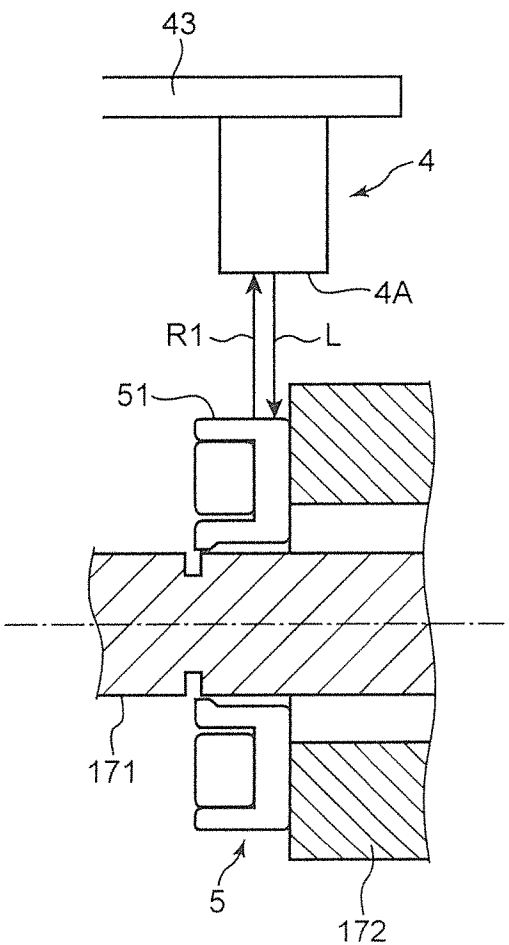
FIG. 4A is an enlarged cross-sectional view illustrating a portion of a first reflecting surface of a reflector.

FIG. 4A is an enlarged cross-sectional view illustrating a portion of the first reflecting surface 51 of the pulley 5, and FIG. 4B is an enlarged cross-sectional view illustrating a portion of the second reflecting surface 52 of the pulley 5. The first reflecting surface 51 reflects the inspection light L emitted from the light emitter 41 at a predetermined first reflection ratio, and provides a first reflection light path along which the inspection light L (reflection light R1 from the pulley 5) is directed to the light receiver 42. The second reflecting surface 52 reflects the inspection light L at a second reflection ratio smaller than the first reflection ratio, and provides a second reflection light path along which the inspection light L (reflection light R2 from the pulley 5) is directed outside the light receiver 42.

One preferred technique to provide a relation "the first reflection ratio>the second reflection ratio" is to provide different colors between the reflecting surfaces. In this case, the first reflecting surfaces 51 are colored in a tone that primarily reflects light of a wavelength of the inspection light L and absorbs little. On the other hand, the second reflecting surfaces 52 are colored in a tone that absorbs more of the light of the wavelength of the inspection light L, and reflects less. For example, the first reflecting surface 51 may be a surface in a light color such as white, and the second reflecting surface 52 may be a surface in a dark color such as black.

Other than this example, it is possible to obtain the relation "the first reflection ratio>the second reflection ratio" by providing the first and the second reflecting surfaces 51, 52 in materials having different optical transmittances. For example, the first reflecting surface 51 may be a surface made of a non-translucent member such as a metal, and the second reflecting surface 52 may be a surface made of a translucent member such as glass or a resin. Alternatively, it is also possible to obtain the relation "the first reflection ratio>the second reflection ratio" by providing different surface conditions between the first and the second reflecting surfaces 51, 52. This aspect is the same as modification made to the reflection light path described later (cf. a modified example in FIG. 11C described later), and for example, by providing the first reflecting surface 51 as a mirror finished surface and the second reflecting surface 52 as a non-mirror finished or rough surface, the reflection ratios of the surfaces may be changed.

In this embodiment, in order to provide the first reflection light path, as illustrated in FIG. 4A, the first reflecting surface 51 is provided as a parallel surface with the roller shaft 171 in a cross-section along an axial direction of the roller shaft 171. A probe surface 4A of the rotation sensor 4 having a plane on which the light emitter 41 and the light receiver 42 are arranged is provided orthogonally to a radial direction of the roller shaft 171 (a direction of the normal line), and faces the pulley 5. Accordingly, the probe surface 4A substantially faces the first reflecting surface 51 directly. Therefore, the reflection light R1 (regular reflection light) out of the inspection light L reflected on the first reflecting surface 51 is directed toward the probe surface 4A and received by the light receiver 42. Here, it is desirable that the first reflecting surface 51 is a mirror surface so that the inspection light L may not be scatted on the first reflecting surface 51, and the reflection light R1 as the regular reflection light from the first reflecting surface 51 reliably enters the light receiver 42.

On the other hand, in order to provide the second reflection light path, as illustrated in FIG. 4B, the second reflecting surface 52 provided as a surface inclined at a predetermined inclination angle θ with respect to the roller shaft 171 in the cross-section along the axial direction of the roller shaft 171. The inclined surface is inclined closer to the roller shaft 171 as a distance from the roller main body 172 in the axial direction increases. Accordingly, the second reflecting surface 52 is inclined to the probe surface 4A of the rotation sensor 4. Therefore, the reflection light R2 out of the inspection light L reflected on the second reflecting surface 52 is not directed to the probe surface 4A, but to a direction away from the roller main body 172 (the direction outside the light receiver 42). Therefore, the reflection light R2 is hardly received by the light receiver 42. Here, it is desirable that the second reflecting surface 52 is a mirror surface so that the inspection light L may not be scatted on the second reflecting surface 52, and the reflection light R2 as the regular reflection light from the second reflecting surface 52 is reliably directed outside the light receiver 42.

As the pulley 5 includes the first and the second reflecting surfaces 51, 52 described above, when the pulley 5 rotates integrally with the roller main body 172, a time period in which the inspection light L is sufficiently received by the light receiver 42 (a time period in which the first reflecting surface 51 faces the probe surface 4A) and a time period in which the inspection light L is hardly received by the light receiver 42 (a time period in which the second reflecting surface 52 faces the probe surface 4A) occur alternately.

Figure 5:
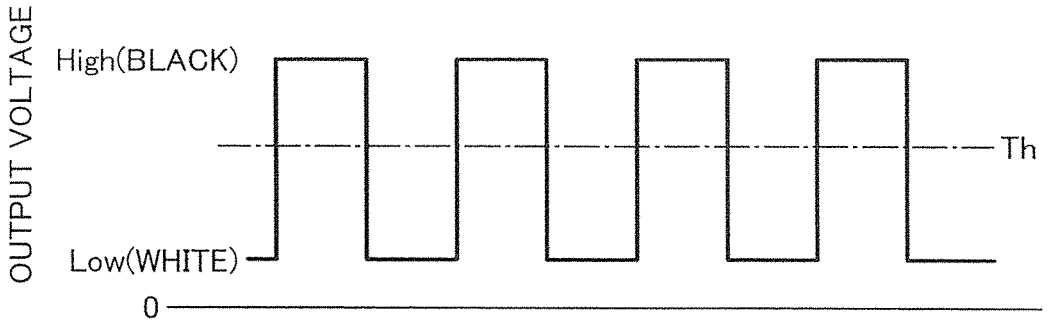
FIG. 5 is a chart showing one example of an output voltage of the rotation sensor.

FIG. 5 is a chart showing one example of an output voltage of the rotation sensor 4. The rotation sensor 4 has a characteristic that its output voltage decreases when the light receiver 42 receives light, and increases when the light receiver 42 does not receive light. Therefore, the output voltage of the rotation sensor 4 changes in a pulse shape as the roller main body 172 rotates. Due to the characteristic of the rotation sensor 4, a time period in which the output voltage is Low corresponds to a time period in which the first reflecting surface 51 (white) faces the probe surface 4A, and a time period in which the output voltage is High corresponds to a time period in which the second reflecting surface 52 (black) faces the probe surface 4A. Accordingly, by determining an appropriate threshold voltage Th between Low and High, and counting a number of pulses that exceed the threshold voltage Th, it is possible to learn the rotating speed of the roller main body 172.

[Significance of Making Reflection Ratios and Reflection Light Paths Different]

The pulsed output voltage as illustrated in FIG. 5 may be obtained only by providing different reflection ratios between the first reflecting surface 51 and the second reflecting surface 52, without providing the second reflection light path by making the second reflecting surface 52 an inclined surface. However, in a case in which displacement occurs in a positional relation between the probe surface 4A of the rotation sensor 4 and the first and the second reflecting surfaces 51, 52 of the pulley 5 due to an inclination, displacement, or the like of the separation roller 17, there is a problem that a pulsed output voltage does not show High-Low clearly.

As described above, the separation roller 17 is removably attached to a predetermined fitting portion (roller attaching portion) of the housing 141 of the sheet cassette 14. In order to realize easy attachment and removal at the fitting portion, the separation roller 17 is attached with a certain degree of play. Therefore, when the separation roller 17 fitted in the fitting portion, the roller shaft 171 is inclinable in a predetermined range with respect to a standard attachment direction that is previously determined.

Figure 6:
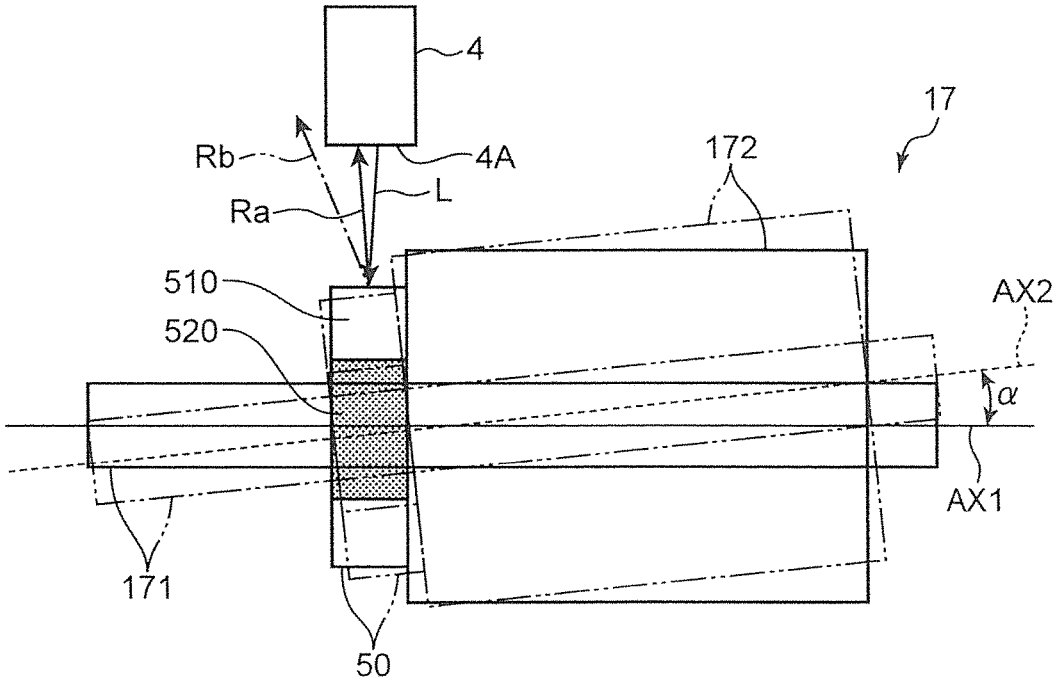
FIG. 6 is a diagram illustrating a separation roller having a reflector according to a comparative example.

FIG. 6 is a diagram illustrating the separation roller 17 having a pulley 50 according to a comparative example. The pulley 50 includes first reflecting surfaces 510 of reflecting surfaces in white (of first reflection ratio) and second reflecting surface 520 of reflecting surfaces in black (of second reflection ratio) alternately arranged along the circumference direction. The first, second reflecting surfaces 510, 520 are flat surfaces without any inclination in the axial direction. Even with the pulley 50 thus configured, as long as the separation roller 17 is regularly attached to the housing 141 without any inclination in the roller shaft 171, it is possible to obtain a pulsed output voltage with a high difference in a wave height as illustrated in FIG. 5 in the rotation detection of the separation roller 17 by the rotation sensor 4.

However, there may be an inclination in the separation roller 17. It is appreciated that this inclination is within an acceptable range and does not affect sheet carrying function of the separation roller 17. FIG. 6 shows, by dotted lines, a state in which the separation roller 17 is attached to the housing 141, in a state in which a shaft center AX2 of the roller shaft 171 is inclined by an inclination angle α with respect to a standard attachment direction AX1 of the separation roller 17 to the housing 141. If there is no inclination in the separation roller 17, the inspection light L emitted from the probe surface 4A of the rotation sensor 4 is directed such that reflection light Ra reflected both on the first and the second reflecting surface 510, 520 returns to the probe surface 4A (the light receiver 42). However, as an amount of the reflection light Ra largely different between the first reflecting surface 510 and the second reflecting surface 520, it is possible to determine High-Low using the threshold voltage Th appropriate for their output voltages.

Figure 7:
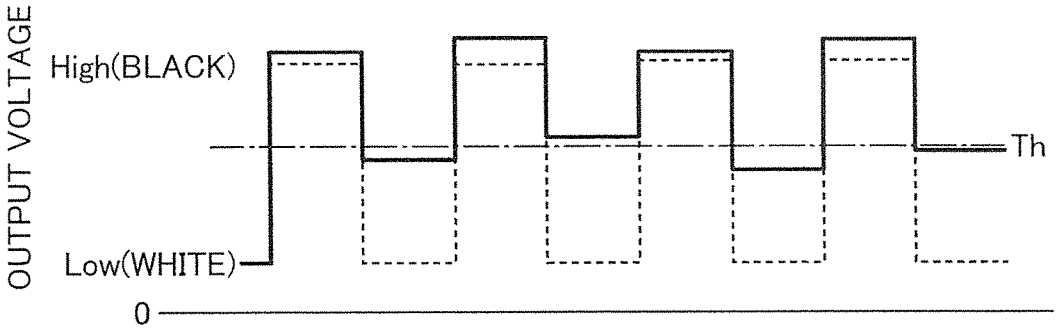
FIG. 7 is a chart showing one example of an output voltage of a rotation sensor in a case in which the reflector according to the comparative example is inclined in an axial direction.

However, if there is any inclination in the separation roller 17, the inspection light L is directed such that the reflection light Rb reflected both on the first and the second reflecting surface 510, 520 tends to be directed outside the probe surface 4A. FIG. 7 is a chart showing one example of an output voltage of the rotation sensor 4 in a case in which the pulley 50 according to the comparative example is used and there is an inclination in the separation roller 17. In this case, an output voltage for the time period in which the first reflecting surfaces 510 (white) faces the probe surface 4A becomes larger than that in the case in which there is no inclination, as an amount of received light by the light receiver 42 decreases. Further, an output voltage for the time period in which the second reflecting surface 520 (black) faces the probe surface 4A decreases compared to the case in which there is no inclination (however, a decreasing ratio is smaller than (white)). Accordingly, at the threshold voltage Th at which the standard attachment is expected, there may be erroneous determination between (white) and (black). Further, as a difference between output voltages in (white) and (black) is small or unstable even if a new threshold voltage Th is to be set, there may be a case in which corrected determination between the outputs from (white) and (black) cannot be carried out.

By contrast, according to this embodiment, while the first reflecting surface 51 is parallel to the roller shaft 171, the second reflecting surface 52 is assumed to be inclined with respect to the roller shaft 171 by the predetermined inclination angle θ (cf., FIGS. 4A and 4B). Therefore, the amounts of light of the reflection light R1, R2 received by the light receiver 42 are largely different, because amounts of light of the reflection light R1, R2 reflected on the first and the second reflecting surfaces 51, 52 are different as the reflection ratios of the reflecting surfaces 51, 52 are different, and also because the reflection light R2 is not directed to the probe surface 4A. Therefore, the difference between High-Low in the output voltage of the rotation sensor 4 is naturally large, and it is possible to easily distinguish the outputs from (white) and (black). Further, even if an inclination occurs in the separation roller 17 and the output voltage in (white) increases slightly, the difference in the output voltages in (white) and (black) is still large enough, and therefore it is possible to correctly determine the outputs in (white) and (black).

[Preferred Second Reflecting Surface]

Next, preferred aspects of the second reflecting surface 52 will be described. It is desirable that the second reflecting surface 52 provides the second reflection light path along which the inspection light L is directed outside the light receiver 42 even in a case in which the separation roller 17 is attached, with the inclination angle α in the acceptable range, to the housing 141. In this regard, description is given with reference to FIG. 8 illustrating the second reflecting surface 52 having a preferred inclined surface.

Figure 8:
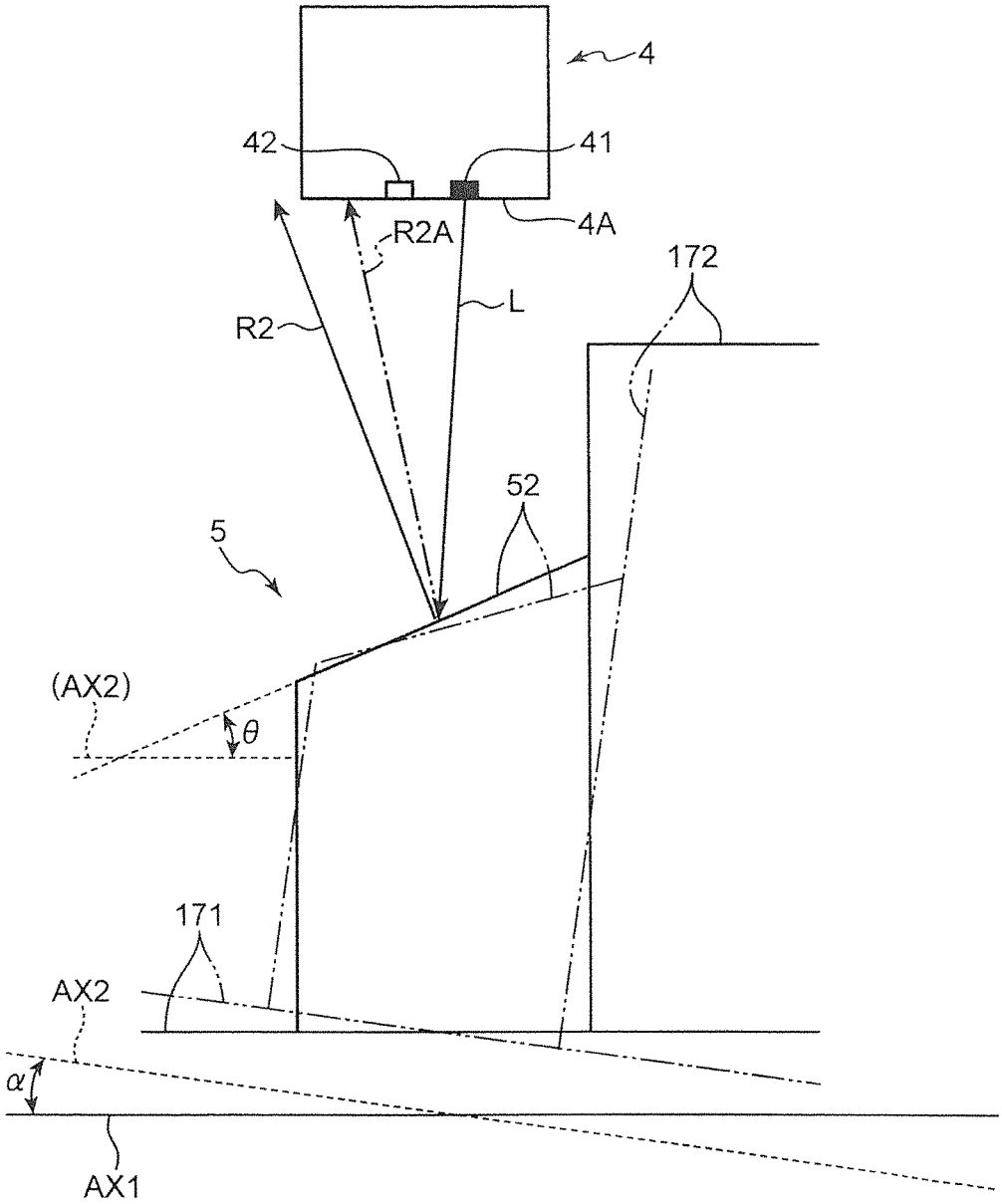
FIG. 8 is a diagram for illustration of a second reflecting surface in the embodiment.

In FIG. 8, a solid line indicates a state in which the separation roller 17 is not inclined, and an alternate long and two short dashes line indicates a state in which the shaft center AX2 of the roller shaft 171 is inclined by the inclination angle α with respect to the standard attachment direction AX1. Here, the inclination angle α is assumed to be a maximum inclination angle that is expected (acceptable) when the separation roller 17 is attached to the housing 141. It should be noted that unlike FIG. 2, FIG. 8 shows the light emitter 41 and the light receiver 42 arranged in the axial direction, for the purpose of illustration (the same applies to FIG. 9).

As described previously, the second reflecting surface 52 is configured as an inclined surface that provides the second reflection light path along which the inspection light L is directed outside the light receiver 42, and hardly allows the reflection light R2 to be let into the light receiver 42. It is desirable that the inclination angle θ of the inclined surface with respect to the shaft center AX2 of the roller shaft 171 is set to such an angle that even if the shaft center AX2 of the roller shaft 171 is inclined by the inclination angle α, reflection light R2A on this inclined surface hardly enters the light receiver 42. Specifically, it is desirable that the inclination angle θ is selected to such an angle that even when the inclination angle α occurs in the roller shaft 171 and in turn the pulley 5 is inclined to change the angle with respect to the standard attachment direction AX1 of the second reflecting surface 52, the reflection light R2A in this case may not hardly enter the light receiver 42.

For example, if it is expected that the roller shaft 171 is inclined up to the inclination angle α=5° within the acceptable range that may not affect the sheet conveying function of the separation roller 17, it is desirable that the inclination angle θ of the second reflecting surface 52>5°. With this, even when an inclination within the expectation occurs in the separation roller 17, the reflection light R2A from the second reflecting surface 52 may not enter the light receiver 42, and the rotation sensor 4 can output a pulsed voltage with a high difference in a wave height.

Next, a desirable direction in which the inclined surface inclines will be described. In this embodiment, the pulley 5 is adjacent to the side surface of the roller main body 172, and the second reflecting surface 52 is inclined closer to the roller shaft 171 as the distance from the roller main body 172 in the axial direction increases. By setting the inclination direction of the second reflecting surface 52 as described above, it is possible to prevent the reflection light from the roller main body 172 from entering the light receiver 42.

Figure 9:
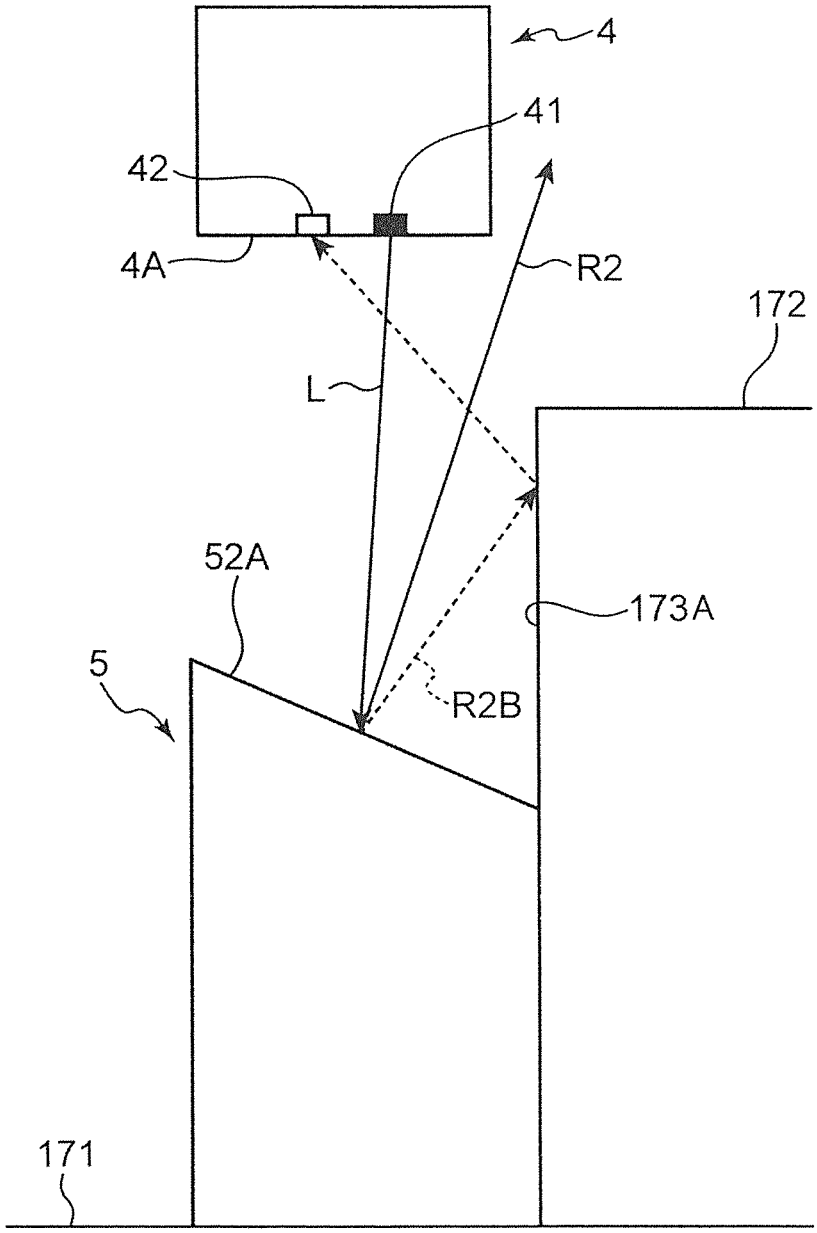
FIG. 9 is a diagram illustrating another example of the second reflecting surface.

FIG. 9 is a diagram illustrating a second reflecting surface 52A according to another embodiment. Here, the second reflecting surface 52 is inclined away from the roller shaft 171 outwardly in the radial direction as the distance from the roller main body 172 in the axial direction decreases. Even with the second reflecting surface 52A, it is possible to provide the second reflection light path along which the reflection light R2 from the second reflecting surface 52A is directed outside the light receiver 42.

However, according to this embodiment, an angle between the second reflecting surface 52A and a roller side surface 173A of the roller main body 172 is 90° or smaller. Therefore, as illustrated in FIG. 9, a light path may be possibly provided along which light flux R2B which is a part of the reflection light R2 reflected on the second reflecting surface 52A is reflected on the roller side surface 173A and directed toward the light receiver 42. If an inclination occurs in the separation roller 17, light flux on an axis of the reflection light along the second reflection light path may possibly be reflected on the roller side surface 173A and enter the light receiver 42. In this case, by providing the second reflecting surface 52 as illustrated in FIG. 8, the inspection light L is reflected to a direction away from the roller main body 172, and reflection on the roller side surface 173A may not easily occur.

Here, it is also desirable that the first reflecting surface 51 provides the first reflection light path along which the inspection light L is directed outside the light receiver 42 even in a case in which the separation roller 17 is attached, with the inclination angle α in the acceptable range, to the housing 141.

[Electrical Configuration of Image-Forming Apparatus]

Figure 10:
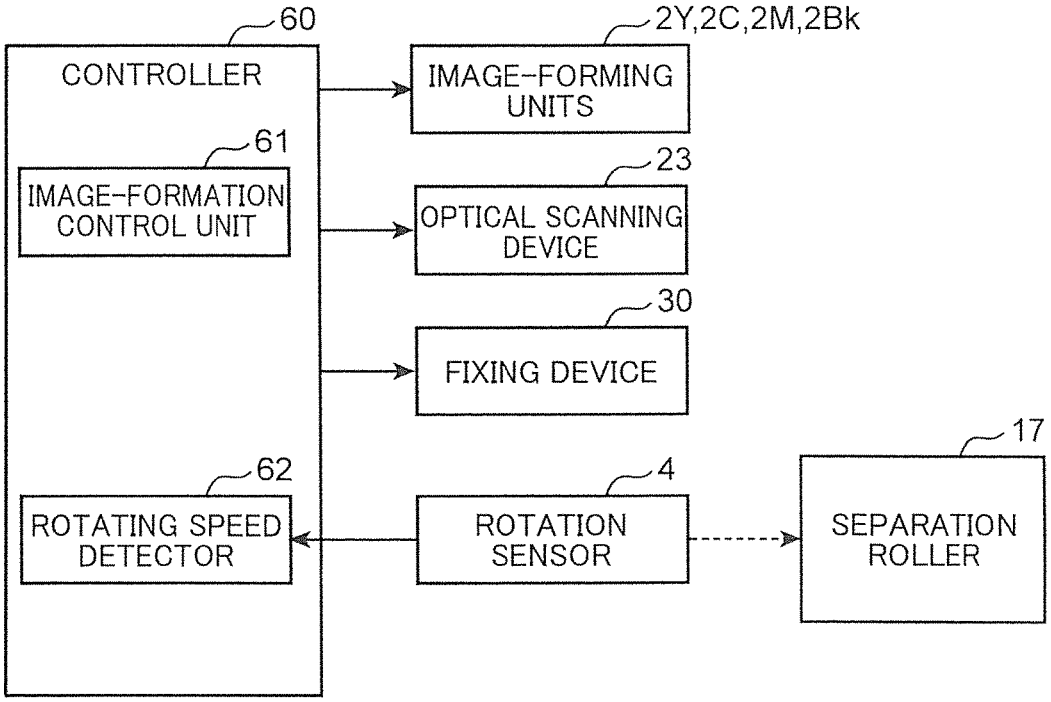
FIG. 10 is a block diagram illustrating an electrical configuration of the image-forming apparatus.

FIG. 10 is a block diagram illustrating an electrical configuration of the image-forming apparatus 1 according to this embodiment. The image-forming apparatus 1 is provided with a controller 60 that controls operations of the components of the image-forming apparatus 1 as a whole. The controller 60 includes an image-formation control unit 61 and a rotating speed detector 62.

The image-formation control unit 61 controls the image-forming operation by the image-forming apparatus 1. Specifically, the image-formation control unit 61 controls operations of the image-forming units 2Y, 2C, 2M, 2Bk, the optical scanning device 23, and the fixing device 30, and further controls formation of an electrostatic latent image to the photoreceptor drum 21, development of the electrostatic latent image by toner, primary transfer of the toner images to the transfer belt 281, secondary transfer of the full-color toner image from the transfer belt 281 to a sheet, and a fusing operation.

The rotating speed detector 62 detects a rotating speed of the roller main body 172 of the separation roller 17, based on a result of the detection by the rotation sensor 4. To the rotating speed detector 62, pulsed output voltages are input from the rotation sensor 4 as illustrated in FIG. 5. The rotating speed detector 62 sets the threshold voltage Th as needed, and counts a number of pulses that exceed the threshold voltage Th for a predetermined unit time. Then, the rotating speed detector 62 derives the rotating speed of the roller main body 172, based on the obtained count number.

By carrying out rotating speed detection of the separation roller 17 as described above, it is possible to monitor time for replacement of the separation roller 17. For example, if the rotating speed of the separation roller 17 is smaller than a predetermined value, the separation roller 17 is considered not to successfully rotate following the feed roller 16, and it is estimated that wear occurs in the roller main body 172 as one reason. Therefore, if the derived value of the rotating speed of the separation roller 17 is equal to or smaller than the predetermined value, the rotating speed detector 62 causes a message that it is time for replacement of the separation roller 17 to be displayed in a display panel (not shown) provided for the image-forming apparatus 1.

[Effects]

According to the image-forming apparatus 1 (sheet feeder) of this embodiment described above, as the second reflecting surface 52 is set to an inclined surface, it is possible to increase a difference between an amount of the reflection light R1 reflected on the first reflecting surface 51 of the pulley 5 (reflector) and enters the light receiver 42, and an amount of the reflection light R2 reflected on the second reflecting surface 52 and enters the light receiver 42, as compared to the case in which reflection ratios are simply made different. Therefore, the rotation sensor 4 can output a pulsed voltage with a high difference in a wave height.

As illustrated in FIG. 6, in the case in which the pulley 50 having the first and the second reflecting surfaces 510, 520 simply having flat surfaces with different reflection ratios is employed, when there is displacement in the positional relation between the rotation sensor 4 and the pulley 50 due to any inclination occurring in the separation roller 17, a difference between an amount of the reflection light entering the light receiver 42 can become smaller between the first and the second reflecting surfaces 510, 520. In this case, the difference in the wave height of the output voltage from the rotation sensor 4 becomes smaller, and there can be an error in the rotating speed detection of the separation roller 17 by the rotating speed detector 62.

However, according to this embodiment, the second reflecting surface 52 is configured as an inclined reflecting surface that provides the second reflection light path along which the inspection light L is directed outside the light receiver 42. Therefore, basically, the reflection light R2 from the second reflecting surface 52 hardly enters the light receiver 42. Therefore, even if displacement occurs in the positional relation between the rotation sensor 4 and the pulley 5, and an amount of the reflection light R1 from the first reflecting surface 51 decreases as a result, it is possible to maintain the difference of the amounts of light from the reflection light R2 from the second reflecting surface 52 at a high level. Therefore, the rotation sensor 4 can output a pulsed voltage with a high difference in a wave height, and the rotating speed detector 62 can correctly carry out rotating speed detection of the separation roller 17.

Further, in a section of the roller shaft 171 along the axial direction, the first reflecting surface 51 is parallel to the axial direction, and the second reflecting surface 52 is inclined to the axial direction. In this manner, the first reflection light path along which the inspection light L is directed toward the light receiver 42, and the second reflection light path along which the inspection light L is directed outside the light receiver 42 are provided with simple surface shapes. With this, by providing the probe surface 4A in the normal line direction of the first reflecting surface 51, the reflection light R1 from the first reflecting surface 51 naturally enters the light receiver 42, and the reflection light R2 from the second reflecting surface 52 is directed outside the light receiver 42, and the device configuration may be simplified and downsized.

As described above, the image-forming apparatus 1 (sheet feeder) according to the embodiment of the present disclosure has been described. However, the present disclosure may not be limited to this embodiment, and the following modified examples may also be employed, for example.

Figure 11A:
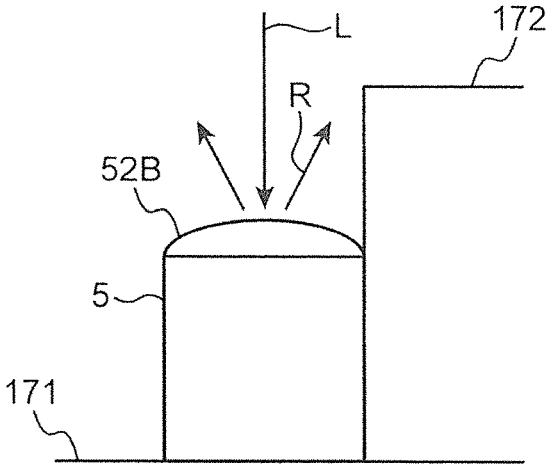
FIGS. 11A to 11C are diagrams illustrating modified examples of the second reflecting surface.
Figure 11B:
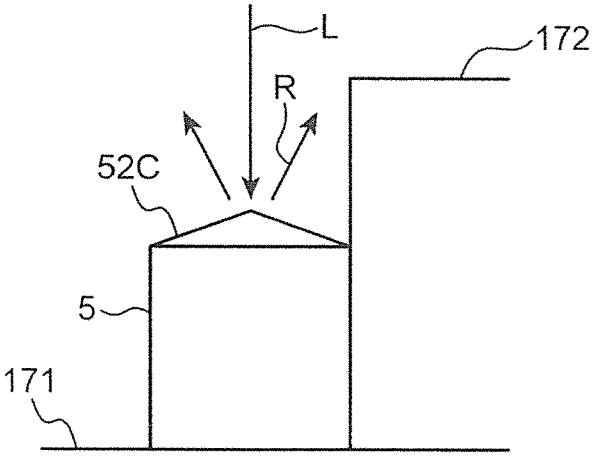
Figure 11C:
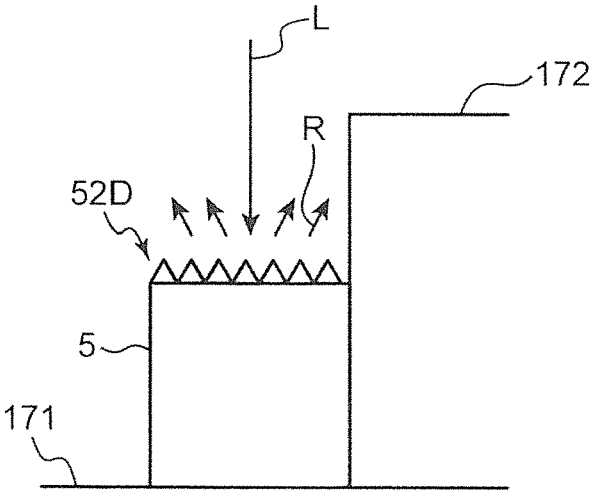

(1) The second reflecting surface 52 is not limited to the inclined surface illustrated in FIGS. 8 and 9, and various configurations can be employed. FIGS. 11A to 11C are diagrams respectively illustrating the second reflecting surfaces 52B, 52C, 52D according to the modified example. The configuration of the second reflecting surface 52 is not particularly limited, as long as the second reflection light path along which the inspection light L is directed outside the light receiver 42 is provided.

FIG. 11A illustrates a second reflecting surface 52B that expands in an arc-like shape to the axial direction of the roller shaft 171. When the second reflecting surface 52B is irradiated with the inspection light L from the normal line direction of the peripheral surface of the roller shaft 171, the reflection light R is mostly directed to a direction angled with respect to the normal line. Therefore, it is possible to cause the reflection light R to not easily enter the light receiver 42 of the rotation sensor 4.

FIG. 11B illustrates a second reflecting surface 52C expanding in a gabled shape to the axial direction of the roller shaft 171. Similarly to the second reflecting surface 52B, even with the second reflecting surface 52C, it is possible to cause the reflection light R to not easily enter the light receiver 42. Further, FIG. 11C also illustrates a second reflecting surface 52D having fine concavity and convexity (a rough surface). When the second reflecting surface 52D is irradiated with the inspection light L, the reflection light R becomes scattered. Therefore, it is possible to cause the reflection light R to not easily enter the light receiver 42.

(2) The above embodiment describes the example in which the separation roller 17 as the driven roller is taken as a target of rotating speed detection. This is merely one example, and any one of various driven rollers or driving rollers provided for the image-forming apparatus 1 may be set as the target of rotating speed detection. For example, the pair of resist roller 18 may be set as the target of rotating speed detection.

(3) The above embodiment describes the example in which the sheet feeder according to this embodiment is assembled to the image-forming apparatus 1. However, the sheet feeder of this embodiment may not be limited to such an example, and can be applied to various devices that require a function for carrying a sheet.

According to the present disclosure described above, even when there is an inclination or positional displacement in the rollers that contribute to conveying of a sheet, it is possible to provide a sheet feeder capable of correctly detecting the rotating speed of the roller and an image-forming apparatus using this sheet feeder.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet feeder, comprising:

a roller including a roller shaft, and a roller main body attached to the roller shaft;

a roller attaching portion to which the roller is attached;

a reflector integrally attached to one of the roller shaft and the roller main body, the reflector including first reflecting surfaces and second reflecting surfaces arranged alternately along a circumference direction of the roller main body;

a sensor including a light emitter that emits inspection light to the reflector, and a light receiver that receives the inspection light reflected on the reflector; and a rotating speed detector configured to detect a rotating speed of the roller based on a result of the detection by the sensor; wherein each of the first reflecting surfaces reflects the inspection light at a first reflection ratio, and provides a first reflection light path along which the inspection light is directed to the light receiver, each of the second reflecting surfaces reflects the inspection light at a second reflection ratio smaller than the first reflection ratio, and provides a second reflection light path along which the inspection light is directed outside the light receiver, in a state that the roller is attached to the roller attaching portion, the roller shaft is inclinable in a predetermined range with respect to a standard attachment direction defined in advance, each of the first reflecting surfaces provides the first reflection light path with the roller inclined in the predetermined range, and each of the second reflecting surfaces provides the second reflection light path with the roller inclined in the predetermined range.

2. An image-forming apparatus, comprising:

an image-forming section configured to form an image on a sheet; and the sheet feeder according to claim 1, the sheet feeder feeding the sheet to the image-forming section.

3. A sheet feeder, comprising:

a roller including a roller shaft, and a roller main body attached to the roller shaft;

a reflector integrally attached to one of the roller shaft and the roller main body, the reflector including first reflecting surfaces and second reflecting surfaces arranged alternately along a circumference direction of the roller main body;

a sensor including a light emitter that emits inspection light to the reflector, and a light receiver that receives the inspection light reflected on the reflector; and a rotating speed detector configured to detect a rotating speed of the roller based on a result of the detection by the sensor; wherein each of the first reflecting surfaces reflects the inspection light at a first reflection ratio, and provides a first reflection light path along which the inspection light is directed to the light receiver, each of the second reflecting surfaces reflects the inspection light at a second reflection ratio smaller than the first reflection ratio, and provides a second reflection light path along which the inspection light is directed outside the light receiver, in a cross-section along an axial direction of the roller shaft, each of the first reflecting surfaces is parallel to the axial direction of the roller shaft, and each of the second reflecting surfaces is inclined to the axial direction of the roller shaft.

4. The sheet feeder according to claim 3, wherein the reflector is arranged adjacently on a side surface of the roller main body in the axial direction, and each of the second reflecting surfaces is inclined closer to the roller shaft as a distance from the roller main body in the axial direction increases.

5. The sheet feeder according to claim 3, wherein each of the second reflecting surfaces expands in an arc-like shape to the axial direction of the roller shaft.

6. The sheet feeder according to claim 3, wherein each of the second reflecting surfaces expands in a gabled shape to the axial direction of the roller shaft.

7. The sheet feeder according to claim 3, wherein the second reflecting surface is a rough surface having fine concavity and convexity thereon.

8. The sheet feeder according to claim 3, further comprising:

a pulley disposed adjacent to a side surface of the roller main body in the axial direction, the pulley having a pulley peripheral surface whose outer diameter is smaller than a peripheral surface of the roller main body, wherein the pulley peripheral surface is configured by the first reflecting surfaces and the second reflecting surfaces arranged alternately along a circumference direction of the pulley, each of the first and second reflecting surfaces having a predetermined width in the circumference direction.

9. The sheet feeder according to claim 3, further comprising:

a driving roller to which a driving force is supplied, wherein the roller is in contact with and rotates following the driving roller.

10. The sheet feeder according to claim 9, wherein the driving roller is a feed roller for feeding the sheet, the roller is a separation roller pressure-contacted to the feed roller, the separation roller preventing the sheet from being fed overlappingly, and the reflector is integrally attached to the separation roller.

11. An image-forming apparatus, comprising:

an image-forming section configured to form an image on a sheet; and the sheet feeder according to claim 3, the sheet feeder feeding the sheet to the image-forming section.

* * * * *